United States Patent [19]

Hilderink

[11] 4,119,820

[45] Oct. 10, 1978

[54] SPRING-DRIVE MECHANISM FOR ELECTRIC SWITCHES

[75] Inventor: Johannes H. L. A. Hilderink, Buurse, Netherlands

[73] Assignee: Hazemeijer B.V., Buurse, Netherlands

[21] Appl. No.: 811,830

[22] Filed: Jun. 30, 1977

[51] Int. Cl.[2] ..... H01H 3/30

[52] U.S. Cl. ..... 200/153 SC; 74/2; 185/40 R

[58] Field of Search ..... 200/153 SC, 323, 324; 74/2; 185/37, 39, 40 R

[56] References Cited

U.S. PATENT DOCUMENTS

| | | | |
|---|---|---|---|
| 895,308 | 8/1908 | Schaar | 185/40 R |
| 2,481,190 | 9/1949 | Binns | 74/2 X |
| 3,255,636 | 6/1966 | Wehrli | 200/153 SC |
| 3,563,098 | 2/1971 | Gley | 74/2 |
| 3,845,433 | 10/1974 | Kravltis | 200/153 SC X |

FOREIGN PATENT DOCUMENTS

| | | | |
|---|---|---|---|
| 1,423,860 | 11/1965 | France | 200/153 SC |

*Primary Examiner*—Stephen Marcus

*Attorney, Agent, or Firm*—Watson, Cole, Grindle & Watson

[57] ABSTRACT

A spring-drive mechanism for controlling the switch-on and switch-off positions of contacts of an electric switch wherein the conventional lever system for relaying the rotating force from the helical spring to the contacts is replaced by a structure which includes a fixed hollow cylinder in which a movable coupling shaft is located, the hollow cylinder having axially staggered wall bores in which balls are positioned, the configuration and positioning of the coupling shaft within the hollow cylinder determining whether one or the other of the balls is positioned to extend outwardly of the outer surface of the cylinder. The hollow cylinder is positioned with one end of a hollow shaft which coaxially encompasses a drive shaft and helical spring combination, the structure including interconnecting projections to provide for selective rotational interengagements between the hollow shaft and the drive shaft.

2 Claims, 10 Drawing Figures

SPRING-DRIVE MECHANISM FOR ELECTRIC SWITCHES

BACKGROUND OF THE INVENTION

The present invention relates to a spring-drive mechanism for electric switches which includes a drive shaft, a switch-on spring which can be put under tension by the drive shaft and which surrounds (coaxially encompasses) this drive shaft, and a hollow shaft situated coaxially around the drive shaft which supports at least one cam disc for operating the contacts of the switches. The mechanism is also one in which one end of the switch-on spring is fixedly connected to the drive shaft and the other end is fixedly connected to the hollow shaft, and includes structure which causes serial rotation of the hollow shaft over a certain angle as a result of influence of the energy stored in the tensioned switch-on spring and thereby causing operation of the switch contacts.

Such a switch-on mechanism is known from the German Auslegeschrift No. 1,690,038.

With known drive mechanisms the helical spring is put under tension by means of an electric motor via a ratchet with pawl, the release movement of the helical spring being opposed by a locking disc with relating locking pawl. By releasing the energy stored in the helical spring, the rotating movement of the helical spring is transmitted to a lever system by means of a cam disc and via the switch shaft on which this spring is wound, such that the rotating movement is converted into a reciprocating movement by which ultimately the movable contacts are operated. By using a lever system, however, the disadvantages of such a system itself are introduced. These disadvantages are for instance the deformation of the lever system resulting from the bending of the bars under the influence of the forces working on them, whilst the mass of the entire lever system influences the acceleration and the declaration of the entire mechanism. Also the various pivots of the lever system form an equal number of points of friction in which a certain amount of energy is lost.

An object of the present invention is to provide a spring drive mechanism of the type mentioned above by which these disadvantages are eliminated by eliminating the lever system, i.e., by applying a more direct drive in which the drive mechanism is more simple and so cheaper in construction.

SUMMARY OF THE INVENTION

The drive mechanism according to the invention is characterized in that the hollow shaft surrounds the switch-on spring over its whole length and the means for rotating the hollow shaft over a certain angle consists of a non-rotatable hollow cylinder extending coaxially within one end of the hollow shaft, the hollow cylinder comprising two axial staggered wall bores in the circumference of the cylinder. Each of the bores houses a ball, and the balls are alternately radially movable by means of a coupling shaft which is axially movable within the chamber of the cylinder, which coupling shaft is provided with parts with opposite changing diameters such that when the coupling shaft is electromagnetically or manually moved in an axial direction, one of the balls is partly pressed out of the cylinder by one of the parts with changing diameter. The inner wall of the hollow shaft is provided with a ridge extending nearly as far as the outer wall of the cylinder, and the arrangement is such that, dependent on the switch-on or switch-off position of the switches and thus on the axial position of the coupling shaft, one of both balls which is pressed outwards will contact the ridge such that the hollow shaft and the cam disc supported by it can only rotate over a certain angle necessary for switching-on or switching-off, respectively.

In the present invention a drive shaft is provided with a helical spring wound around it, one end of which is fixedly connected to this drive shaft and the other end of the helical spring is connected to the rotatable part of a coupling, the rotatable part also being connected to a tube co-axially surrounding the drive shaft and being rotatably supported with respect to this shaft by means of a ball bearing situated on this drive shaft at the one end and by means of the rotatable part of the coupling at the other end, the tube also being provided with two cam discs which are fixedly connected to the outer surface of the tube.

One end of the drive shaft is positioned in a ball bearing positioned in a frame, the other end of which is rotatably supported by the rotatable part of the coupling. By means of a toothed wheel fixedly connected to the drive shaft and a pinion fixed to the shaft of a drive motor, the drive shaft can be driven by means of the motor (which is also connected to the frame), such that the helical spring present on the drive shaft can be brought under tension. A spring being brought under tension in this way will try to release itself such that the tube, connected to the spring through the rotatable part, will try to rotate also. This rotation, however, is opposed by the coupling, the operation of which can take place manually or by means of a remote controlled electromagnet. When switched-on the coupling is operated in such a way that the helical spring is no longer arrested but can release itself such that the tube with the cam disc connected to it can rotate.

In consequence of the rotation of the cam discs, a bridge, mutually connecting the contacts of the switches to guarantee a synchronized movement of the contacts, is moved downwardly by means of rolls supported by the bridge near the cam discs and lying against the discs. During the switching-on, the switch-off spring and the contact-pressure spring are brought under tension in the known way such that switching off occurs when the tube and the cam discs are rotated over a certain angle by means of the coupling, by which the bridge, under the influence of the switch-off spring acting upon it, is urged upwardly and the contacts are separated from each other. It is obvious that by varying the shape of the cam discs, the switch-on velocities can be rather closely adjusted to the requirements in a fairly simple way.

To prevent switching-on from taking place when the helical spring is substantially untensioned, a locking device is incorporated in the drive shaft assuring that the switch-on movement of the coupling is blocked when the spring is substantially untensioned. This prevents the switch being swiched-on with a too low velocity or only partly.

This drive mechanism is characterized in that the end of the drive shaft, cooperating with the coupling, is provided with a locking device located in a co-axial bore in the drive shaft consisting of a shaft slidably located in this co-axial bore and which is provided with a groove extending along the length of the shaft in which a tongue extends from a disc which is slidable along the shaft, such that this disc is non-rotatably connected to the shaft. The disc is shaped such that it can be taken along with the ridge in the rotatable part of the coupling, the shaft at the end nearest to the drive shaft having a cut out portion providing a short length surface and a longer surface, these surfaces being connected by such that a pin which is fixed in the drive shaft forces the shaft to move away from the drive shaft when the spring is untensioned because the inclined surface of this shaft rotates along the pin such that the coupling shaft is prevented from moving towards the drive shaft and the switch is locked against switching-on, the surface of the shaft with the smallest length being situated opposite the pin when the switch-on spring is tensioned, such that the coupling shaft can be moved freely to and fro and the switch can be switched on.

The invention will now be further explained by way of reference to the accompanying drawings, which depict an embodiment of the invention.

DETAILED DESCRIPTION OF THE PREFERRED EMBODIMENT

Figure 1:
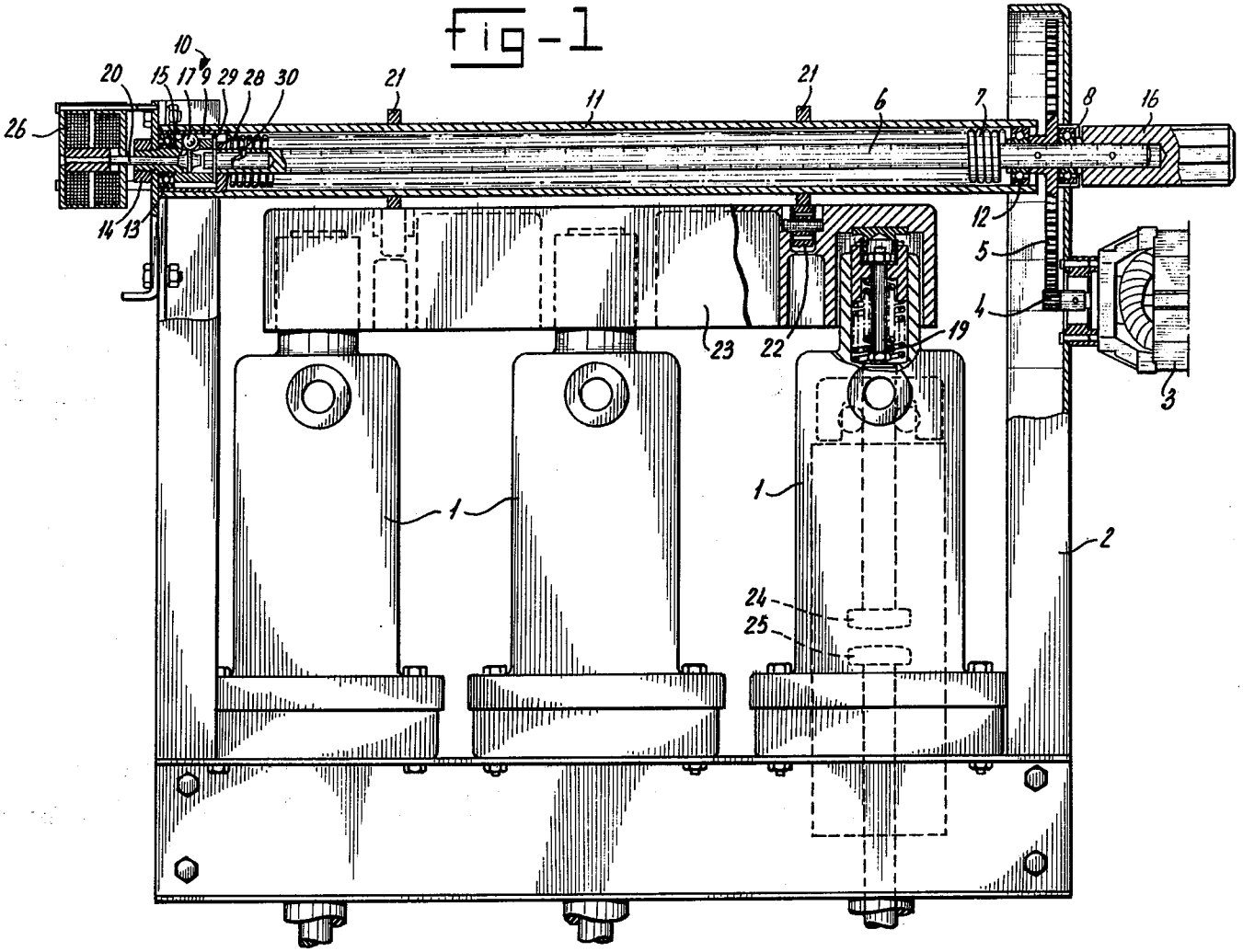
FIG. 1 shows, partially in section, an embodiment of the drive mechanism according to the invention with the related switches schematically shown.

As is shown in FIG. 1, a drive shaft 6, which is encased within a helical spring 7, is supported at one end by a ball bearing 8, which is itself fitted in frame 2. The other end of the drive shaft 6 is mounted in a rotatable part 9 of coupling 10. A tube 11 is coaxially positioned around drive shaft 6, and is rotatably mounted by way of ball bearing support 12 at one end and by mounting on rotatable part 9 of coupling 10 at the other. The rotatable part 9 of coupling 10 is clamp fitted against the tube 11 by means of ball bearing 13 mounted on fixed part 15 of coupling 10, which part 15 is connected to frame 2 by nut 14 and is in the shape of a hollow cylinder with internal chamber 39.

The end of the drive shaft 6 which is supported by ball bearing 8 is fixedly connected to a toothed wheel 5, which through pinion 4 is connected to a wind-up motor 3. Wind-up motor 3 is mounted on frame 2 and pinion 4 is attached to the shaft of the motor. In addition to being driven by motor 3, drive shaft 6 can be manually rotated by inserting a special key into sleeved shaft 16 which itself is secured to shaft 6 at a point outside of frame 2. Rotation of drive shaft 6 causes helical spring 7 to be wound up because one end of spring 7 is fixedly connected to the drive shaft 6, the other end being secured in the rotatable part 9 of coupling 10, which rotatable part 9 can be fixed with respect to the fixed cylinder 15 of the coupling 10 by means of a ball 17.

Figure 2:
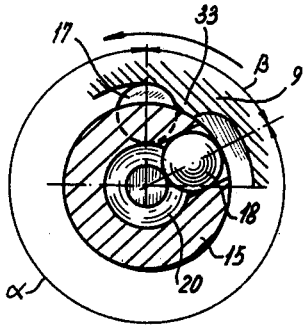
FIG. 2 shows a cross sectional view of a detail of the coupling in the off-position of the switch.
Figure 3:
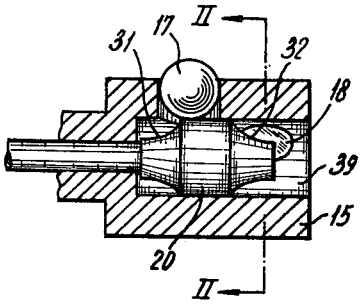
FIG. 3 shows a longitudinal section of a detail of the coupling according to FIG. 2.
Figure 10:
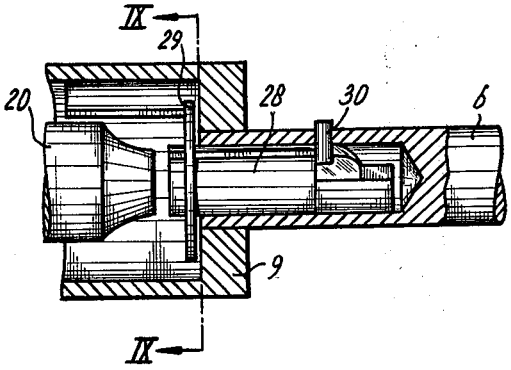
FIG. 10 shows a longitudinal view of the detail according to FIG. 9.

FIGS. 2 and 3 depict a part of coupling 10 in detail, the various parts being shown in the off-position, FIG. 3 showing a longitudinal sectional view and FIG. 2 showing a section along line II — II of FIG. 3. The rotatable part 9 is shaped as a sleeve and a passage opening is provided in the center of the bottom thereof (see FIGS. 7 and 10) in which the drive shaft 6 is rotatably supported, one end of the spiral spring 7 being connected to this rotatable part 9.

The fixed hollow cylinder 15 is externally shaped such that the ball bearing 13 which is mounted on the cylinder can be connected to the frame 2 by means of a nut 14. The interior of the cylinder is additionally provided with an axial bore which extends into communication with cylindrical chamber 39.

Figure 5:
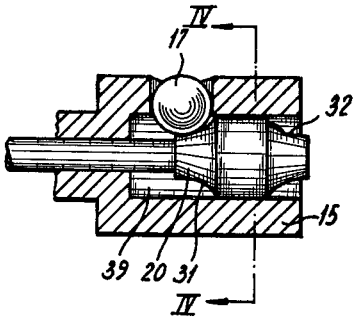
FIG. 5 shows a longitudinal section of the detail of FIG. 4.

The coupling shaft 20 extends into the chamber 39 within fixed cylinder 15 through the axial bore, the shaft 20 including an expanded cylindrical part which is connected to the smaller diameter part by sloping shoulders 21, 32. The expanded cylindrical part is of such dimensions as to be easily slidable within chamber 30. A ball 17 (see FIG. 3) is positioned to fit in a first radial bore in the cylinder which opens into the chamber 39 so as to be either engagable with the expanded cylindrical part of the coupling shaft 20 (FIG. 3), or with the sloping shoulder 31 (FIG. 5). In this latter case the entire ball resides within the diameter of the external surface of the fixed hollow cylinder 15.

A second radial bore is provided in the cylinder 15 to communicate with chamber 39, this second radial bore being radially and axially staggered with respect to the first radial bore. A second ball 18 resides in the second radial bore, and based on the positioning of the coupling shaft 20, and thus the expanded cylindrical portion thereof, the ball 18 is positioned (like ball 17) to be either within the diameter of the external surface of the fixed hollow cylinder 15 or to extend outside of that diameter.

When the switch is in the off-position, i.e., as shown in FIGS. 2 and 3, the coupling shaft 20 will be in such a position that the ball 17 will be forced to extend outwardly beyond the outer diameter of the cylinder 15, such that the rotatable part 9, which will be biased to rotate in the direction of the arrow (FIG. 2) under the influence of the tensioned spiral spring 7, via ridge 33, which is situated at the inner side of the rotatable part 9 and which extends along the longitudinal direction of the rotatable part 9 in a radial fashion, will be forced against the ball 17 and further rotation of part 9 will be prevented.

Figure 4:
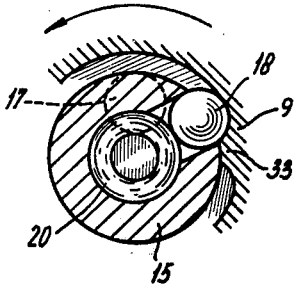
FIG. 4 shows a sectional view of the same detail of the coupling, however, in the on-position of the switch.

When the switch is in the switched-on position (see FIGS. 4 and 5), the expanded cylindrical portion of coupling shaft 20 will be in such a position that ball 18 will be forced to extend outwardly beyond the outer diameter of the cylinder 15, whereas ball 17 will be within the outer diameter and resting against sloped shoulder 31. With this positioning of balls 17 and 18, rotatable part 9 will be enabled to rotate over an angle $\alpha$ (see FIG. 2) such that the tube 11 and the cam discs 21 attached thereto (FIG. 1) will rotate over this angle also. Due to the configuration of cam discs 21, this rotation will cause a downward movement of bridge 23 (via rolls 22), and movable contacts 24 of the switches 1 will be brought into engagement with the fixed contacts 25 such that the switches will be in an "on" positioning. At a later time, when the coupling shaft is returned to the position as shown in FIG. 2, the rotatable part 9 will then rotate over an angle $\beta$, which will, by way of a conventional spring construction, cause the contacts 24, 25 to separate such that the switches will be in an "off" positioning.

In the presently described embodiment the coupling 10 is operated by means of an electromagnet 26 which can be remotely controlled. However, it is also possible to manually control the coupling 10 without the need of remote operations.

Figure 6:
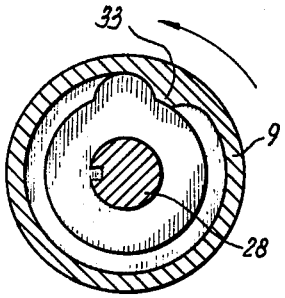
FIG. 6 shows a sectional view of a detail of the locking mechanism when the spring is untensioned.
Figure 7:
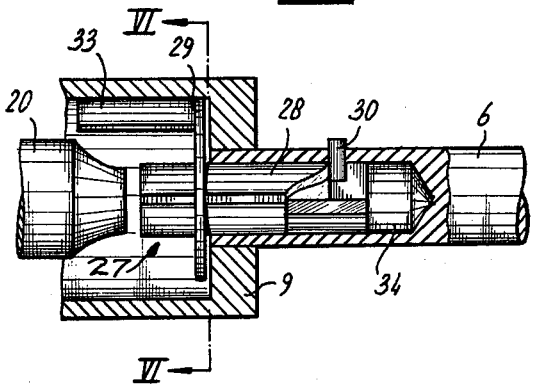
FIG. 7 shows a longitudinal section of the detail of FIG. 6.
Figure 9:
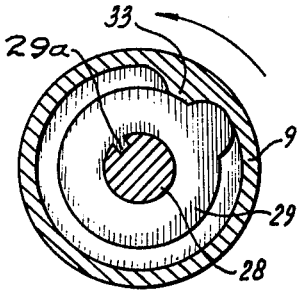
FIG. 9 shows a cross sectional view of a detail of the locking mechanism when the spring is tensioned.

To prevent the switch from being switched on when the spring 7 is insufficiently tensioned, the drive shaft 6 is provided with a locking mechanism 27. In FIGS. 6 and 7 this locking mechanism 27 is shown in detail in a position in which the helical spring is untensioned. The locking mechanism is fabricated as follows: a controlling shaft 28 is positioned to extend into a concentric bore 34 in the end of drive shaft 6 supported by the rotatable part 9, the controlling shaft 28 being both rotatable and slidable with bore 34. The controlling shaft 28 has a groove 35 which extends in the longitudinal direction thereof which is non-rotatably connected to a disc 29 (see FIG. 9) by way of a tongue 29*a* on disc 29. The disc 29 is slidable along the controlling shaft 28 in its longitudinal direction.

Figure 8:
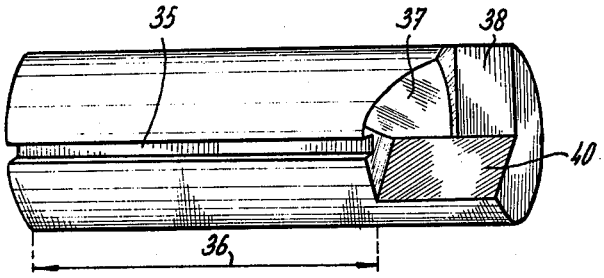
FIG. 8 shows a view of the shaft of the locking mechanism.

It can be seen from FIG. 8, which shows the right hand end of the controlling shaft 28 on an enlarged scale, that it is partly cut away so as to produce a surface 38 which is oriented parallel with the longitudinal axis of the shaft 28, a surface 40 which is also oriented parallel with the longitudinal axis of the shaft 28, and an inclined surface 37 which extends essentially between the two surfaces 38 and 40. Surface 38 is seen to have a shorter dimension along the longitudinal axis of shaft 28 than surface 40. In the position shown in FIGS. 6 and 7 the helical spring 7 is untensioned. The pin 30 which is connected to shaft 6 extends into the bore 34 and within the cut away portion of controlling shaft 28 such that it rests against surface 38 of controlling shaft 28. As such, controlling shaft 28 is caused to extend (at its opposite end) into the chamber 39 of the fixed cylinder 15 sufficiently that the coupling shaft 20 will be prevented from moving towards drive shaft 6 (thus the switch will be locked against positioning in an "on" position).

When the drive shaft 6 is rotated so as to tension the helical spring 7, the pin 30 will rotate also within the cut away section of controlling shaft 28 until the pin 30 stops against surface 40, thereby allowing the controlling shaft 28 to move to the right. Thereafter, the controlling shaft 28 will rotate together with the drive shaft 6 until the helical spring is completely tensioned. The controlling shaft 28 can rotate until the position depicted in FIGS. 9 and 10. At this point the disc 29 will engage with the ridge 33 of rotatable part 9. Because the pin 30 will be resting against surface 40, which has a longer dimension along the longitudinal axis of controlling shaft 28 than surface 38, the controlling shaft 28 will be moved to the right and coupling shaft 20 will be allowed to move to the right sufficiently to turn the switch to the "on" position.

If the switch is switched "on" in the foregoing fashion and is thereafter switched "off", the helical spring 7 will normally be untensioned too greatly to guarantee a correct switch-on. Thus, the switching-on is locked due to the fact that the ridge 33 of part 9 will cause disc 29 to rotate, and thus controlling shaft 28, during the switching-on and switching-off. In this way controlling shaft 28 with its inclined part 37 will move against pin 30 such that rotation of controlling shaft 28 will cause it to move out of bore 34 and towards the coupling shaft 20 until the positioning depicted in FIGS. 6 and 7 is again reached.

It is obvious that the invention is not limited to the embodiment shown in the drawings and described above, additional and modifications being possible without falling outside the scope of the invention.

I claim:

1. In a spring-drive mechanism for electric switches which includes a drive shaft, a switch-on spring which can be put under tension by the drive shaft and which surrounds this drive shaft as well as a hollow shaft situated coaxially around the drive shaft and supporting at least one cam disc for operating the contacts of the switches, one end of the switch-on spring being fixedly connected to the drive shaft and the other end being fixedly connected to the hollow shaft, means being present to rotate the hollow shaft each time over a certain angle under the influence of the energy stored in the tensioned switch-on spring and operating the switch contacts in consequence thereof.

the improvement wherein the hollow shaft surrounds the switch-on spring over its whole length, wherein the means for rotating the hollow shaft over a certain angle includes a non-rotatable hollow cylinder extending coaxially within one end of the hollow shaft, said hollow cylinder including two axially staggered wall bores in the circumference of the cylinder, each bore of which contains a ball, said balls being alternately radially movable by means of a coupling shaft which is axially movable within the chamber of said hollow cylinder, said coupling shaft including surfaces with oppositely changing diameters such that when the coupling shaft is electro-magnetically or manually moved in axial direction one of said balls is partly pressed to extend outwardly of the outer surface of said cylinder by one of said surfaces with changing diameter, the inner wall of the hollow shaft being provided with a ridge extending nearly as far as the outer wall of the cylinder, the arrangement being such that, dependent on the switch on or switch off position of the switches and thus on the axial position of the coupling shaft, one of both balls which is pressed outwards, will arrest the ridge such that the hollow shaft and the cam disc supported by it can only rotate over a certain angle ($\alpha$,$\beta$) necessary for switching-on or switching-off of the switch contacts.

2. A drive mechanism according to claim 1, wherein the end of the drive shaft which cooperates with the coupling is provided with a locking device located in a coaxial bore in the drive shaft which comprises a controlling shaft slidably located in said coaxial bore and is provided with a groove extending along the length of the controlling shaft in which a tongue of said disc extends such that the disc is slidable along the controlling shaft, said disc being shaped such that it can be taken along with the ridge of the rotatable part of the coupling, the controlling shaft at the end nearest to the drive shaft being cut out such that this controlling shaft has a surface of smaller longitudinal dimension, a surface of larger longitudinal dimension, and an inclined surface formed therebetween, a pin which is fixed in the drive shaft being positioned within said cut out portion of said controlling shaft so as to force the controlling shaft to move away from the drive shaft when the spring is untensioned because said inclined surface of said controlling shaft rotates along the pin to reposition the placement of said locking shaft such that the coupling shaft is prevented from moving towards the drive shaft and the switch is locked against switching-on, the surface of the controlling shaft with the smaller longitudinal dimension being situated opposite the pin when the switch-on spring is tensioned, such that the coupling shaft can be moved freely to and fro and the switch can be switched-on.

* * * * *